US012247488B2

(12) United States Patent
Kern

(10) Patent No.: US 12,247,488 B2
(45) **Date of Patent: *Mar. 11, 2025**

(54) MODULAR TUNNEL FORMWORK DEVICE

(71) Applicant: KERN Tunneltechnik SA, Paradiso (CH)

(72) Inventor: Reiner Kern, Paradiso (CH)

(73) Assignee: KERN Tunneltechnik SA, Paradiso (CH)

( * ) Notice: Subject to any disclaimer, the term of this patent is extended or adjusted under 35 U.S.C. 154(b) by 247 days.

This patent is subject to a terminal disclaimer.

(21) Appl. No.: 18/062,218

(22) Filed: Dec. 6, 2022

(65) Prior Publication Data

US 2023/0220774 A1 Jul. 13, 2023

(30) Foreign Application Priority Data

Jan. 7, 2022 (EP) ..... 22150523

(51) Int. Cl.
*E21D 11/40* (2006.01)
*E21D 11/10* (2006.01)

(52) U.S. Cl.
CPC ..... *E21D 11/102* (2013.01); *E21D 11/105* (2013.01); *E21D 11/40* (2013.01)

(58) Field of Classification Search
CPC ..... E21D 11/40; E21D 11/02; E21D 11/105; E21D 11/28; E21D 11/12
See application file for complete search history.

(56) References Cited

U.S. PATENT DOCUMENTS 1,082,700 A * 12/1913 McArthur ..... E21D 11/102 405/150.1
3,863,793 A * 2/1975 Fujimori ..... E21D 19/04 299/33
3,885,397 A * 5/1975 Fujimori ..... E21D 11/40 405/288
3,896,629 A * 7/1975 Stevens ..... E21D 11/40 405/148

(Continued)

FOREIGN PATENT DOCUMENTS

CN 105422137 A 3/2016
CN 106640131 B 1/2019
KR 20190140266 A 12/2019

*Primary Examiner* — Benjamin F Fiorello
(74) *Attorney, Agent, or Firm* — Welsh Flaxman & Gitler LLC

(57) ABSTRACT

A modular tunnel forming apparatus includes at least two modules which are arranged one behind the other in the longitudinal direction of the tunnel formwork device and are detachably connectable to one another. The at least two modules each have a frame part, and the frame parts of the interconnected modules form a frame of the tunnel formwork device. At least two support structures, which can be connected to the frame of the tunnel formwork device and are spaced apart from one another in the longitudinal direction of the tunnel formwork arrangement, are provided for supporting the frame on a tunnel floor. The frame carries at least two support cylinders at at least two positions spaced apart from one another in the longitudinal direction, which support cylinders can be connected to longitudinal beams extending in the longitudinal direction, which longitudinal beams carry tunnel formwork elements of the tunnel formwork device.

17 Claims, 9 Drawing Sheets

(56) References Cited

U.S. PATENT DOCUMENTS

| | | | | |
|---|---|---|---|---|
| 3,970,200 | A * | 7/1976 | Goetjen | E21D 11/40 405/148 |
| 4,315,701 | A * | 2/1982 | Ivanov | E21D 11/102 405/150.1 |
| 4,371,290 | A * | 2/1983 | Ivanov | E21D 11/102 405/150.1 |
| 4,450,666 | A * | 5/1984 | Trumbull | F27D 1/1621 52/749.15 |
| 2017/0254202 | A1* | 9/2017 | Kern | E21D 11/10 |
| 2020/0002957 | A1* | 1/2020 | Mancini | E21D 11/102 |
| 2021/0148231 | A1* | 5/2021 | Mancini | E21D 11/102 |

* cited by examiner

MODULAR TUNNEL FORMWORK DEVICE

BACKGROUND OF THE INVENTION

1. Field of the Invention

The invention relates to a modular tunnel formwork device for concrete lining of tunnel walls.

2. Description of the Related Art

Until now, the concrete lining of tunnel walls has been carried out by tunnel formwork fixtures that have to be erected and dismantled on site. The erection and dismantling of the device is carried out individually at each construction site and takes considerable time, which significantly increases the overall cost of a tunnel project.

SUMMARY OF THE INVENTION

It is therefore the task of the invention to create a tunnel formwork device that enables faster assembly and disassembly and also easier transport of the tunnel formwork device between different construction sites.

This task is solved by a modular tunnel formwork device including at least two modules, which are arranged one behind the other in a longitudinal direction of the tunnel formwork device and can be detachably connected to one another. The at least two modules each have a frame part, and the frame parts of the at least two modules form a frame of the tunnel formwork device. The modular tunnel formwork device also includes at least two support structures, which can be connected to the frame of the tunnel formwork device and are spaced apart from one another in the longitudinal direction of the tunnel formwork device, for supporting the frame on a tunnel floor. The frame carries at least two support struts, particularly support cylinders in at least two mutually spaced positions in the longitudinal direction. The support cylinders can be connected to longitudinal beams extending in the longitudinal direction. The longitudinal beams carry tunnel formwork elements of the tunnel formwork device.

The task is further solved by a mobile formwork arrangement including the modular tunnel formwork device and at least three transport vehicles for receiving the modules and supporting structures. The transport vehicles are formed in particular by an articulated truck or an articulated trailer of a freight train.

The task is also solved by a tunnel concreting device including the modular tunnel formwork device and at least one concrete pump which is controlled by the control arrangement for controlling the support cylinders of the tunnel concreting device. The tunnel concreting device also includes at least one delivery line of the concrete pump connected to an intermediate space between the tunnel formwork elements and a tunnel wall. The concrete pumps are preferably controllable in dependence on signals from load sensors arranged in connection with the support cylinders.

Advantageous further embodiments of the invention are also disclosed in the description and in the figures.

According to the invention, the tunnel formwork device has a modular structure and comprises at least two modules which are arranged one behind the other in the longitudinal direction of the tunnel formwork device and can be detachably connected to one another, the at least two modules each having a frame part, and the frame parts of the interconnected modules forming a frame of the tunnel formwork device. In addition, the tunnel formwork device has at least two support structures, which can be connected to its frame and are spaced apart from one another in the longitudinal direction of the tunnel formwork arrangement, for supporting the frame on a tunnel floor. These support structures are preferably arranged on the outer frame parts spaced apart from each other in the longitudinal direction, so that the frame is securely supported at its longitudinal ends by the support structures on the tunnel floor.

In addition, at at least two positions spaced apart from one another in the longitudinal direction, the frame carries at least two support cylinders or support struts in each case, which are preferably designed at least in part as hydraulically length-adjustable support cylinders that can be connected to longitudinal beams of the tunnel formwork device running in the longitudinal direction. These in turn carry tunnel formwork elements of the tunnel formwork device, which form the tunnel formwork.

According to the invention, a tunnel formwork device is thus formed by at least two modules, preferably by at least three modules connected to each other in the longitudinal direction of the tunnel formwork device, the length of which can be adjusted by the number of modules used. This has the advantage that the length of the tunnel formwork device can be individually adjusted as desired by the number of intermediate modules selected. It should be noted that the longitudinal direction of the tunnel formwork device coincides with the tunnel direction.

Optionally, the width of each module can be varied, for example by adapter pieces or by a hydraulic adjusting mechanism, so that not only the length of the tunnel formwork device in the longitudinal direction of the tunnel, but also the width of the tunnel formwork device can be adjusted according to the width of the modules. The working width of the modules can also be varied simply by adjusting the support structures and the length-adjustable hydraulic support cylinders accordingly so that both narrow and wide tunnel shapes can be formed. The tunnel shape is thereby adjusted by a corresponding adjustment of the length of the support cylinders, which are preferably hydraulic telescopic cylinders. By appropriately varying the standing width of the support structures, which are preferably adjustable both in their spacing in the transverse direction as well as in their height, adapted stability can be achieved even for wide tunnels. The vertical support cylinders do not have to be hydraulically adjustable in length, since the height adjustment of the tunnel formwork device can also be realized via the support structures.

Due to the fact that the entire tunnel formwork device is of modular design, it can be transported comparatively easily, i.e. by common transport vehicles, such as semitrailer trucks or semi-trailers of freight trains. For example, if the length of a module in the tunnel direction is between 1 and 4 m and the width is between 3 m and 10 m, conventional semitrailer trucks can be used to transport the modules because official maximum width and length regulations for transports via railway and on streets need not be exceeded.

Preferably, the modules comprise two end modules, which form the two ends of the tunnel formwork device in the longitudinal direction, and at least one intermediate module to be arranged between the end modules, which can be positively and/or non-positively connected to at least one of the two end modules. The end modules can thus be designed specifically for the load-bearing function, e.g. for fastening the support structures, while the intermediate modules are designed for supporting the tunnel formwork by the support cylinders and the longitudinal beams. This distributes the different necessary functions of the tunnel formwork device, such as load-bearing function and supporting function of the tunnel formwork, to different module types, which is more economical and efficient than if one single module has to provide all these functions.

Preferably, the support structure is height-adjustable and is formed in particular by hydraulically telescopic support legs. The tunnel formwork device can thus be adapted to different tunnel heights. Preferably, the distance between the support legs can also be adjusted transversely to the tunnel direction so that the support structure can be adapted to different tunnel widths. If the support structures are height-adjustable, the vertical support cylinders need not necessarily be designed as hydraulically length-adjustable support cylinders, since the height adjustment can then be implemented via the support structures. Height adjustability also has the advantage that the tunnel formwork device can enter the tunnel at a reduced height, i.e. lowered, so that the tunnel formwork does not collide with tunnel sections that are already shuttered.

The two support cylinders are preferably each supported on the frame part of at least two modules. For example, the support cylinders can be formed on the frame part of each intermediate module so that a number of support cylinders corresponding to the number of intermediate modules is provided to support the longitudinal beams, which in turn support the tunnel formwork elements against the tunnel wall.

Preferably, the frame part of each module, preferably only of the intermediate modules, carries at least six support cylinders, two of which project at least approximately vertically upwards, and four of which are directed horizontally or obliquely upwards or downwards. In this way, the circular arc-shaped tunnel formwork elements are supported over the circumference at least at six points of the tunnel wall, which makes it possible to securely support the tunnel formwork elements to form the tunnel formwork.

Preferably, at least one working platform is mounted on the frame, in particular on the frame of the two end modules, which is supported on the frame in a movable manner, in particular in a height-adjustable and/or laterally adjustable manner via a hydraulic lifting device. In this way, the correct formation of the tunnel formwork can be checked at all points. In addition, this at least one movable working platform helps in positioning the tunnel formwork elements and in maintenance or assembly work. The lifting devices are preferably controllable via a common control arrangement of the tunnel formwork device or separately via controls of the working platforms.

Preferably, two working platforms are arranged in connection with the frame of each end module on the two end sides of the tunnel formwork device, so that the entire span of the tunnel formwork can be approached with these two working platforms.

Preferably, the support cylinders are connected to load sensors so that the load absorbed by each support cylinder can be monitored at a central control arrangement and, if necessary, pressure peaks can be relieved by controlling the support cylinders accordingly. Here, of course, each support cylinder is preferably provided with a load sensor. The pressure peaks are reduced by controlling the concreting speed.

Preferably, at least one of the at least two support cylinders is hinged to the frame or the frame part of a module, particularly an intermediate module, so that the support points for the tunnel formwork elements can be adapted to the local conditions. Alternatively or additionally, the longitudinal beams can be connected to the support cylinders via a pivoting mechanism so that the longitudinal beams can optimally engage behind the tunnel formwork elements, even if the support by the support cylinders is not exactly vertical from below.

In an advantageous further development of the invention, the longitudinal beams have hydraulically actuated plungers, in particular at their ends, for support on the tunnel wall or the tunnel ceiling. This fixes the longitudinal beams absolutely immovably between the supporting structures of the frame of the tunnel device and the punches, which, hydraulically actuated, rest firmly against the tunnel walls or the tunnel ceiling. When the tunnel formwork elements are backfilled with concrete, there is therefore no spatial change in the position of the tunnel formwork elements because they are clamped absolutely stationary.

Preferably, each support structure is formed by two support legs in each case, which can be detachably connected to the frame, preferably to the outermost frame parts of the end modules or intermediate modules in the longitudinal direction. For example, only the end modules can have the fastening structures for the support structures or support legs, which on the one hand ensures that the support structures are arranged at the two ends of the tunnel formwork device, and thus securely support the tunnel formwork device arranged there between. On the other hand, this allows the intermediate modules to carry only those structures that are required to support the tunnel formwork, that is, the hydraulic support cylinders. As already explained, these legs are preferably both height-adjustable and adjustable in their mutual distance.

In an advantageous further development of the invention, only the frame parts of the intermediate modules support the hydraulic support cylinders, and the frame parts of the end modules each support at least one working platform and the support structures, the working platform projecting beyond the support structures on the end face.

To ensure a simple structure of the tunnel formwork device, each module, preferably each end and intermediate module, has integrated connections for pneumatics and/or hydraulics and/or electrics.

The hydraulic support cylinders are connected to the longitudinal beams via at least one bolt, in particular a conical bolt, so as to ensure that the hydraulic support cylinder and the support strut are firmly connected.

In an advantageous further development of the invention, the tunnel formwork device has a control module with a control arrangement for the tunnel formwork device, which is preferably connectable to the frame. The control module can be formed, for example, by a cabin of the tunnel formwork device or a control box in which the control arrangement is arranged, on the one hand, to be easily operated there and, on the other hand, to protect it from the dirt and moisture in the tunnel. This control arrangement then has all the necessary interfaces for the hydraulics, electrics and pneumatics of all the tunnel formwork device modules and is able to receive the force measurement data from the load sensors of the support cylinders and to carry out the adjustment and actuation of the support cylinders centrally for the entire tunnel formwork device.

Preferably, a hydraulic lifting device supports a working platform on the frame parts of the end modules and/or intermediate modules of the tunnel formwork device, which can be raised relative to all frame parts by means of the lifting device. The working platform preferably extends over the entire length of the tunnel formwork device. When lowered by means of the lifting device, the working platform can be lowered onto the frame parts.

The invention also relates to a mobile formwork arrangement with a tunnel formwork device as described above and with at least three transport vehicles, each transport vehicle having a trailer for receiving at least one module, and the further components such as supporting structures, working platforms, longitudinal beams, control module etc. Thus, for transporting a tunnel formwork device with a number of transport vehicles is necessary, which correlates with the number of modules. This has the advantage that a tunnel formwork arrangement of very different lengths can be easily transported by a corresponding number of transport vehicles. Preferably, the two end modules and each intermediate module have fastening elements, in particular in their corner or edge areas, for fixing on the trailer. For example, one or two modules can be transported on a trailer.

At least one semi-trailer of a transport vehicle preferably includes fastening elements for receiving the supporting structures, and preferably a semi-trailer of a further transport vehicle includes fastening elements for the longitudinal beams.

In a further advantageous further development of the invention, one of the transport vehicles contains a trailer for the control module, preferably a cabin or a control box, in which the central control arrangement is arranged, the central control arrangement being designed for controlling the electrics, hydraulics and, if appropriate, pneumatics of the tunnel formwork device. The control module, preferably designed as a cabin, with the central control arrangement can preferably be connected to the frame of the tunnel formwork device, e.g. in the area of a working platform.

As already explained above, a conventional truck tractor or a semi-trailer of a freight train can serve as the transport vehicle. The tunnel formwork equipment of any length can thus be easily transported over long distances by a corresponding number of wagons or trucks. This facilitates universal use even in very remote locations.

The invention also relates to a tunnel concreting device comprising a tunnel formwork device of the above type and at least one concrete pump which is controlled by the control arrangement for controlling the support cylinders of the tunnel concreting device, wherein at least one delivery line of the concrete pump is connected to the intermediate space between the tunnel formwork elements and the tunnel wall. The concrete pumps are preferably controllable in response to signals from load sensors arranged in connection with the support cylinders. In this way, a tunnel of fairly arbitrary cross-sectional shape and length can be efficiently formed, with the control of the concrete pumps dynamically taking into account the degree of backfilling of the space between the tunnel formwork and the tunnel wall.

Preferably, the length of the hydraulic support cylinders is adjustable in length by at least a factor of 1.5, preferably by at least a factor of 2, which is possible by means of several telescopic stages.

It is appreciated that the embodiments of the invention described above can be combined in any way.

BRIEF DESCRIPTION OF THE DRAWINGS

The invention is described schematically below in the accompanying drawing.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
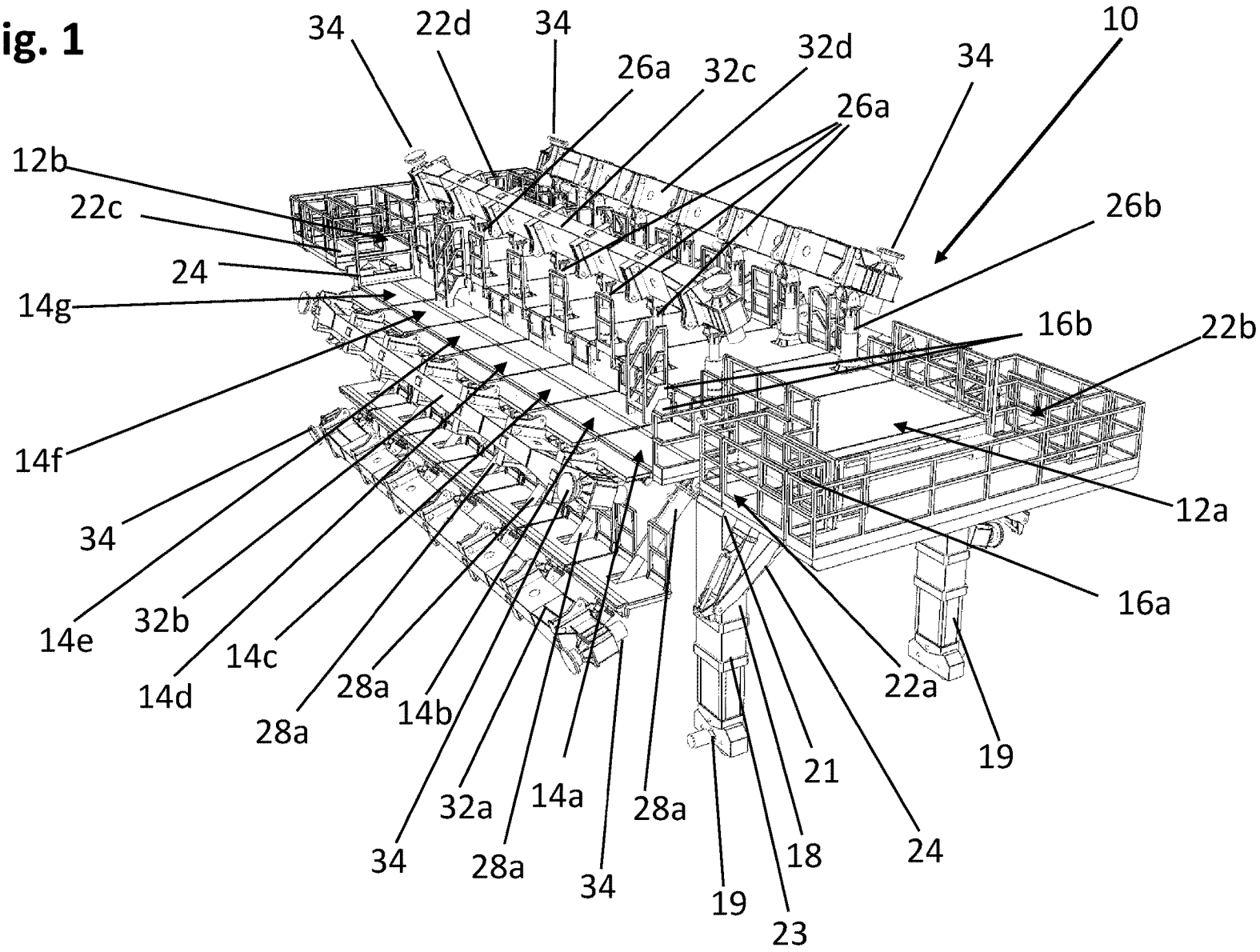
FIG. 1 is a perspective view of a tunnel formwork device composed of two end modules and seven intermediate modules.
Figure 2:
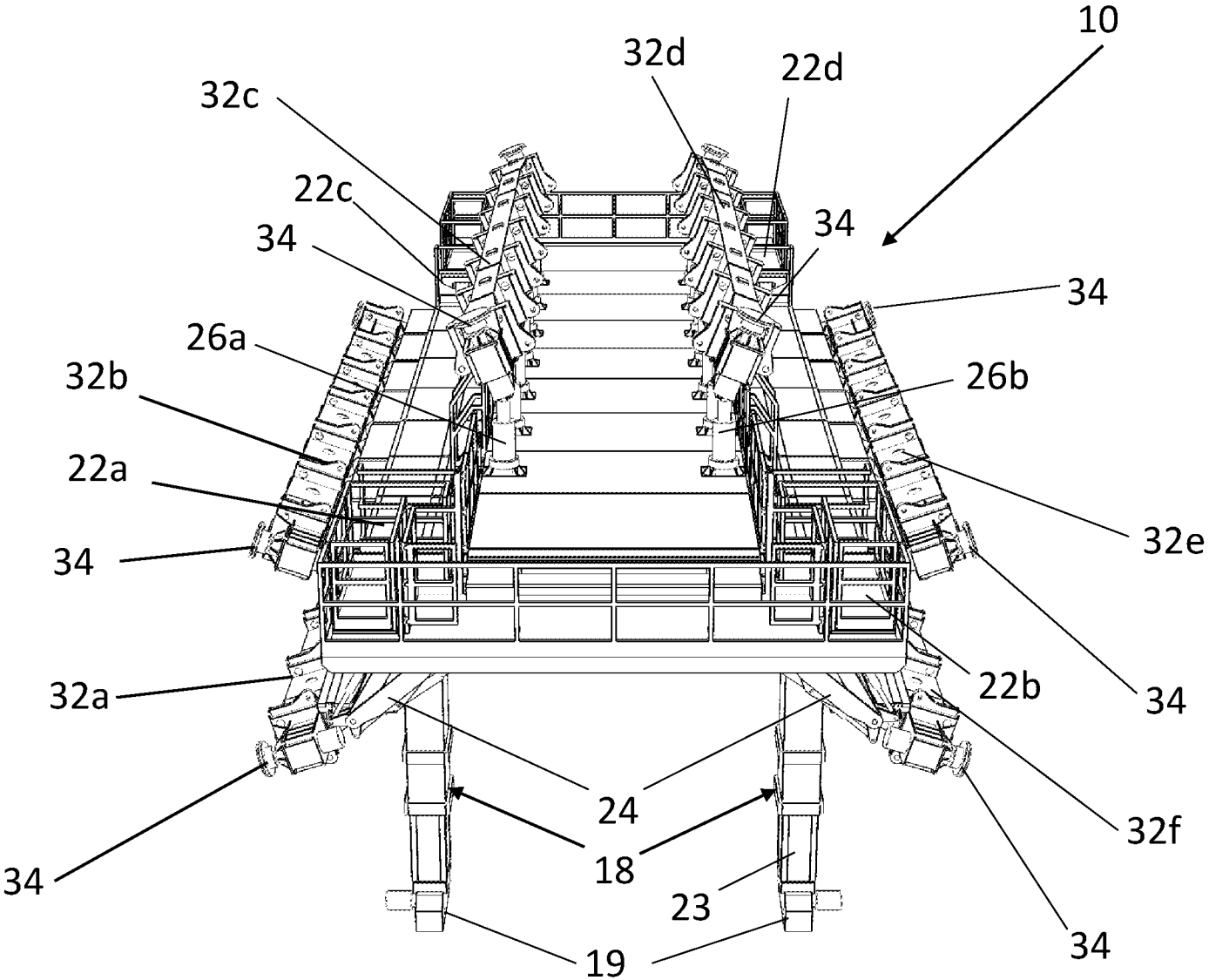
FIG. 2 is a perspective view in longitudinal direction of the tunnel formwork device.
Figure 3:
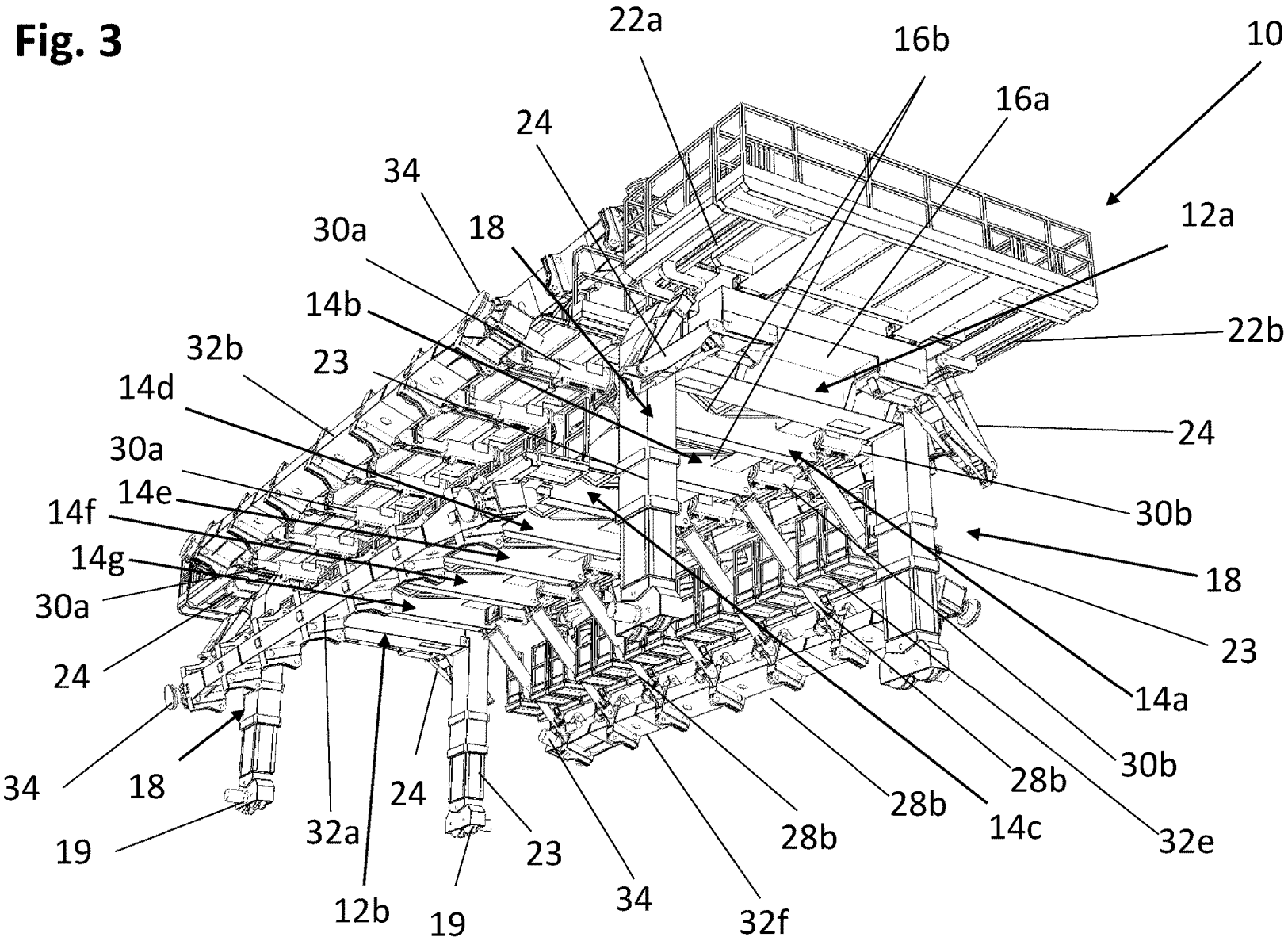
FIG. 3 is a perspective view of the tunnel formwork device of FIG. 1 from diagonally below.

The modular tunnel formwork device 10 according to the invention is described below with reference to FIGS. 1 to 3. The modular tunnel formwork device 10 comprises two end modules 12*a*, 12*b* and seven intermediate modules 14*a*-14*g* extending between the two end modules 12*a*, 12*b*, which modules are fixedly connected to each other. Each end module 12*a*, 12*b* includes a frame part 16*a* which is positively and/or non-positively connected to the frame parts 16*b* of the intermediate modules 14*a-g*, and also the frame parts 16*b* of the intermediate modules 14*a-g* are positively and/or non-positively connected to one another preferably in the same manner to form a common frame 20 of the tunnel formwork device 10. The frame parts 16*a* of the end modules 12*a*, 12*b* can be connected to supporting structures 18 here embodied as two supporting legs of each end module 12*a*, 12*b*, which securely support the frame 20 of the entire tunnel formwork device 10, formed by the frame parts 16*a*, 16*b* of all modules 12*a*, 12*b*, 14*a-g*, on the tunnel floor. At the lower end of each support leg 18 is arranged a support foot 19 with rollers, which can be moved along a path or rails in the longitudinal direction of the tunnel in the course of tunnel forming. The connection between the modules 12*a*, 12*b* and 14*a-g* and/or between their frame parts 16*a*, 16*b* is detachable so that the individual modules can be transported separately to the construction site. The support legs 18 are preferably height-adjustable via a hydraulic telescopic mechanism 23, while their mutual spacing in the transverse direction (horizontally transverse to the tunnel direction) is adjustable via a horizontal telescopic mechanism 21 or by means of insertable adapter pieces.

Two working platforms 22*a*, 22*b* and 22*c*, 22*d* respectively are supported on the frame parts 16*a* of the end modules 12*a*, 12*b* via a hydraulic lifting device 24, which can be raised relative to the frame parts 16*a* of the end modules 12*a*, 12*b* and can also be moved laterally, so that inspections or assembly work on the tunnel formwork elements, on the longitudinal beams and on the support cylinders can be carried out via these working platforms 22*a-d*. The frame 20 extends at least approximately over the entire length of the tunnel formwork device 10. Two vertical hydraulic support cylinders 26*a*, 26*b* are preferably attached to the frame 20 for each intermediate module 14*a-g*, so that when the frame 20 is raised via the hydraulic telescopic mechanisms 23 of the support legs 18 for height adjustment, the vertical support cylinders 26*a*, 26*b* are also raised. In this way, tunnels of different heights can be formed and concreted with the tunnel formwork device 10. The vertical support cylinders 26*a*, 26*b* therefore do not necessarily need to be hydraulic and adjustable in length.

Figure 4:
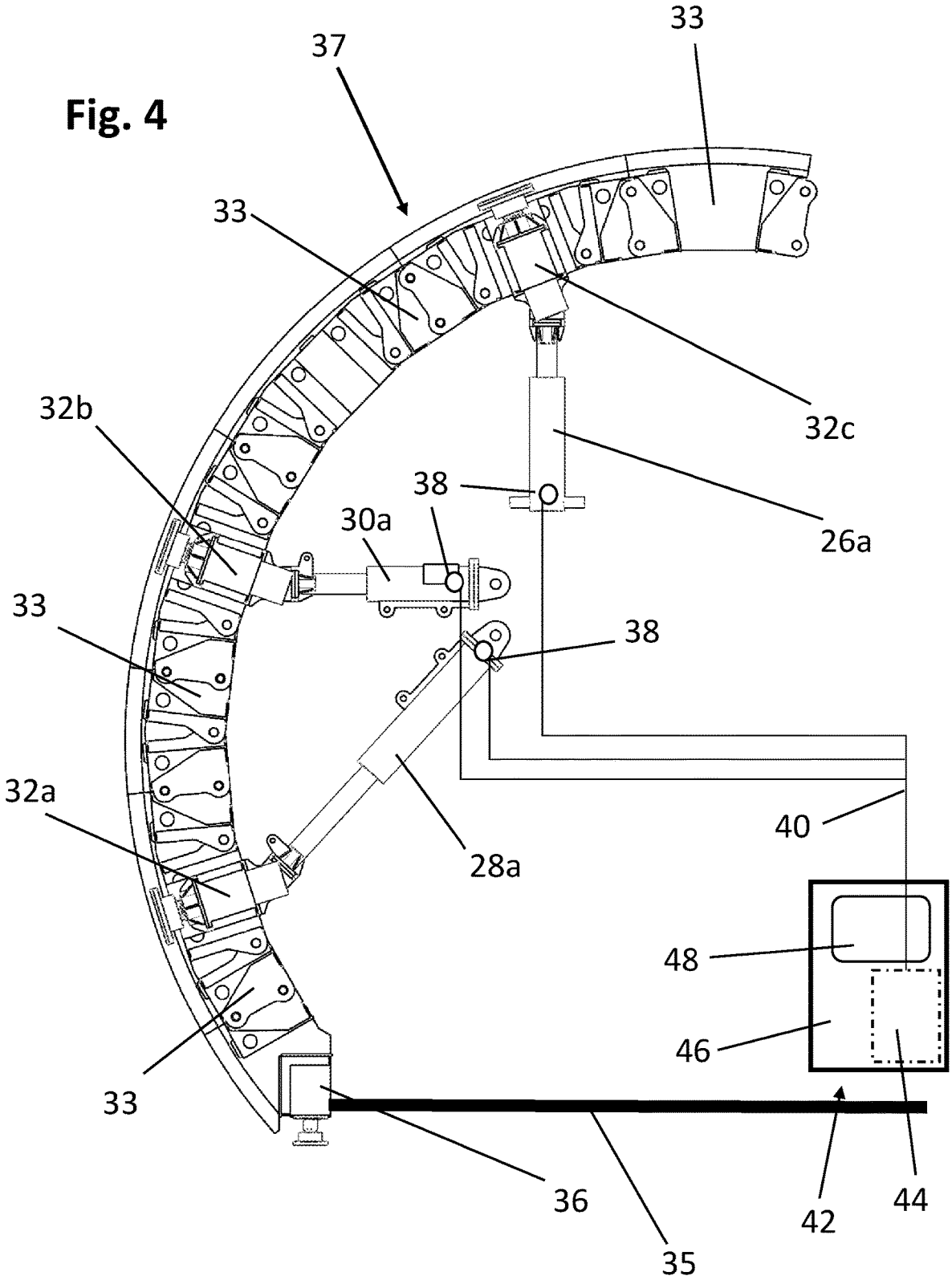
FIG. 4 is a side view of the tunnel formwork positioned by the support cylinders and the longitudinal beams towards the tunnel wall.

Each frame part 16*b* of the intermediate modules 14*a-g* carries two obliquely downward pointing support cylinders 28*a*, 28*b* as well as two horizontally extending support cylinders 30*a*, 30*b*, which extend symmetrically with respect to the tunnel center towards the tunnel sides facing away from each other. The free ends of the supporting cylinders 26*a*, 26*b*, 28*a*, 28*b*, 30*a*, 30*b* are each connected to longitudinal beams 32*a-f*, which in turn support circular-arch tunnel formwork elements 33 (FIG. 4), which in their entirety form the tunnel formwork 37. The tunnel formwork device 10 shown in the figures thus controls six supporting cylinders or struts 26*a*, 26*b*, 28*a*, 28*b*, 30*a*, 30*b*, which extend over the entire inner circumference of the tunnel wall to be concreted, i.e. generally over a range of 150 to 270 degrees (see FIGS. 2 and 4). The tunnel formwork elements 33 may be supported on the tunnel floor 35 by separate support beams 36. Alternatively, the supporting cylinders 28*a* and 28*f*, which point downward at an angle, may form the lowest support of the tunnel formwork 37 assembled by the totality of the tunnel formwork elements 33. The support of the tunnel formwork 37 by the supporting cylinders 26*a*, 26*b*, 28*a*, 28*b*, 30*a*, 30*b* and by the longitudinal beams 32*a*, 32*b*, 32*c* is illustrated in FIG. 4. It is also evident from this illustration that the vertical support cylinders 26*a*, 26*b* do not have to be aligned exactly vertically, just as the horizontal support cylinders 30*a*, 30*b* do not have to be aligned exactly horizontally. These can be adjustable in their angle of attachment to the frame parts of the intermediate modules 14*a-g* at least in a small range of, for example, +/−15 degrees, while the support cylinders pointing downwards at an angle can preferably be adjustable in a larger angular range of, for example, 45 degrees. The support struts 26*a*, 26*b* are preferably rigidly, i.e. not pivotally, attached to the frame 20 so that the tunnel formwork has its angular position fixed, and the tunnel formwork 37 thus cannot tilt while the tunnel formwork device is in motion.

Needless to say, preferably all support cylinders 26*a*, 26*b*, 28*a*, 28*b*, 30*a*, 30*b* are provided with load sensors 38, which can be connected via data lines 40 to the central control arrangement 44 of a control module 42 of the tunnel formwork device 10. The control arrangement evaluates the data from the load sensors 38 and preferably also controls the support cylinders as a function of the recorded data in order to optimally position the tunnel formwork 37 and to actuate concrete pumps for filling the space between the tunnel wall and the tunnel formwork 37 in such a way that there is no excess load on the support cylinders or the tunnel formwork elements 33. On the tunnel formwork device 10, six longitudinal beams 32*a-f* are each supported by seven hydraulic support cylinders 26*a*, 26*b*, 28*a*, 28*b*, 30*a*, 30*b*, which are connected to the seven individual intermediate modules 14*a-g*. In this way, the forces of the tunnel formwork 37 can be effectively absorbed by the tunnel formwork device 10, with the force transfer in the driving condition ultimately occurring through the support structures 18 into the tunnel floor 35. The two ends of each of the longitudinal beams 32*a-f* are provided with hydraulically actuated rams 34, which are controlled in such a way that they bear against the tunnel walls, whereby all longitudinal beams 32*a-f* are fixed in their position between these and the support structures 18, resulting in reproducible formwork results.

The control module 42 preferably includes a cabin 46, preferably with at least one window 48, in which the control arrangement 44 is positioned. In this way, it is effectively protected from the dirt and moisture of the construction site. The control module 42 may be positioned anywhere on the tunnel formwork device 10. Preferably, it is connectable to the support structure 18 or to a frame part 16*a*, 16*b* of an end or intermediate module 12*a*, 12*b*, 14*a-g*. The control arrangement for the tunnel formwork device is connected to hydraulics for actuating all support cylinders and to concrete pumps for filling the cavity between the tunnel wall and the tunnel formwork 37 to optimally control the tunnel forming operation.

The end modules 12*a*, 12*b* preferably carry working platforms 25*a*, 25*b* that project over the end faces of the support structures or support legs 18 so that the ends of the tunnel formwork 37 and the entire tunnel formwork device can be easily viewed via these working platforms.

Figure 5:
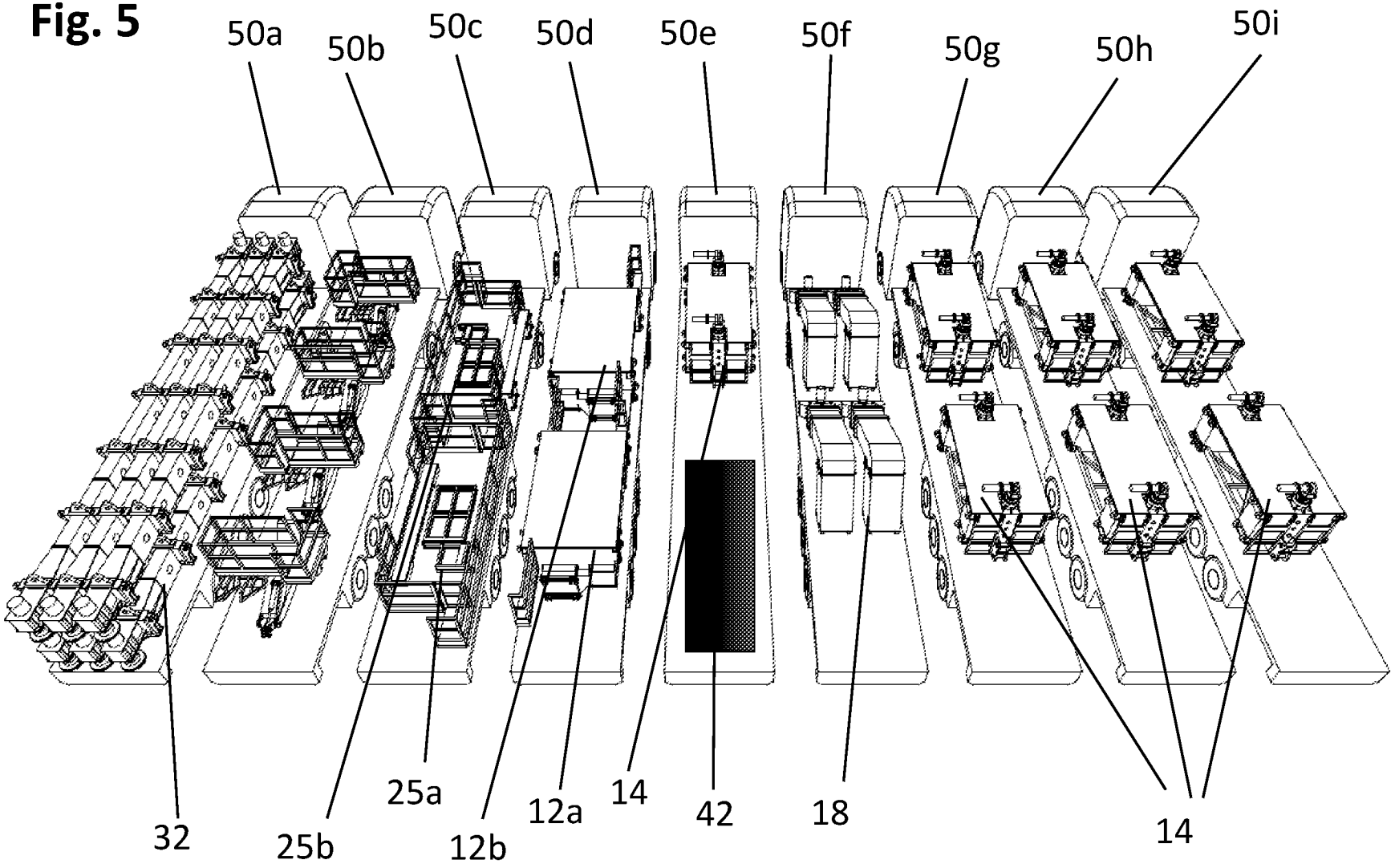
FIGS. 5 to 7 are perspective views of a mobile formwork arrangement with nine transport vehicles.
Figure 6:
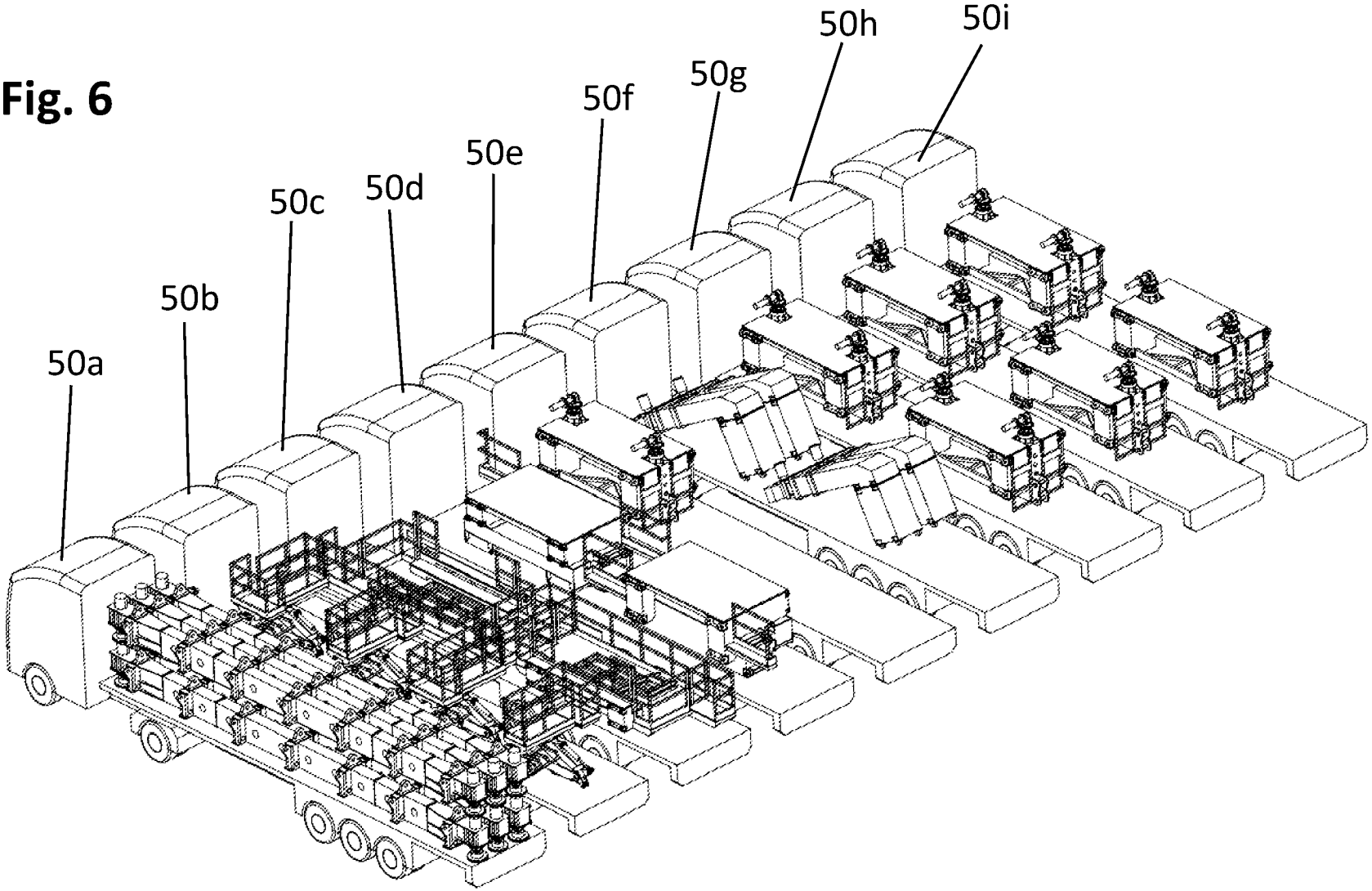
Figure 7:
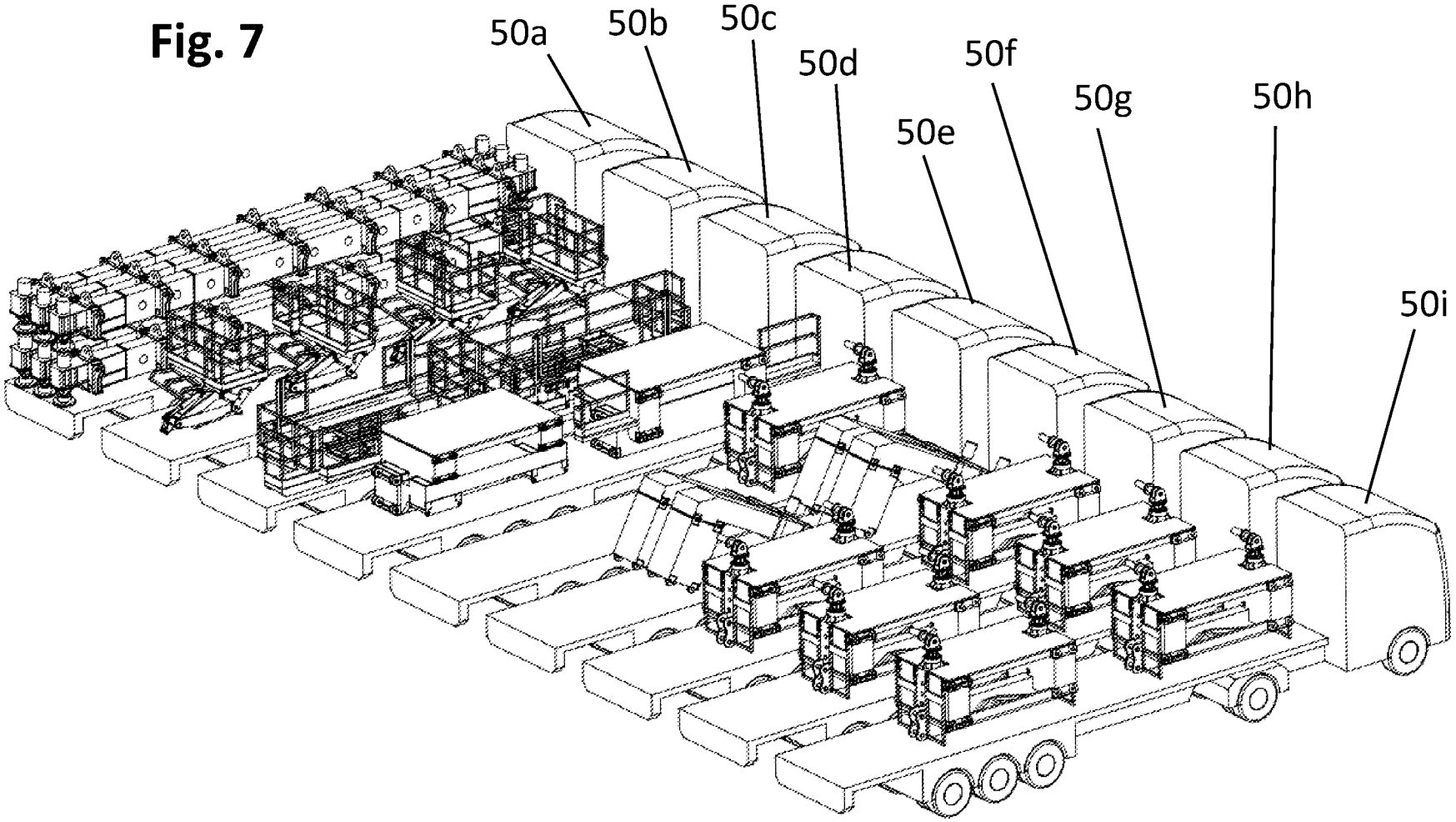

As FIGS. 5 to 7 illustrate, the tunnel formwork device shown in FIGS. 1 to 4 can be effectively transported, in the present case by nine transport vehicles 50*a-i* in the form of semitrailer trucks. For example, the left-hand transport vehicle 50*a* carries the longitudinal beams 32*a-f* of the transport device, while the two transport vehicles 38*b* and 38*c* to its right carry parts of the working platform 22. The next right transport vehicle 50*d* carries the two end modules 12*a*, 12*b* and the transport vehicles 50*e*, 50*g*, 50*h* and 50*i* carry the seven intermediate modules, while the fourth transport vehicle 50*f* from the right carries the four support legs 18 of the tunnel formwork device 10.

On the middle transport vehicle 50*e*, in addition to an intermediate module 14, the control module 42 can also be transported, i.e. a cabin 46 with the control arrangement 44 of the tunnel formwork device 10, so that in fact all essential components of the tunnel formwork arrangement are transported on the transport vehicles 50*a-i* and can be easily assembled on site. An additional transport vehicle may optionally be provided for electrical, hydraulic and pneumatic infrastructure elements, such as lines, hydraulic cylinders, support cylinders and the like. At least one transport vehicle may include a crane for assembling the modules 12, 14 and the support structure 18 and all other components.

Figure 8:
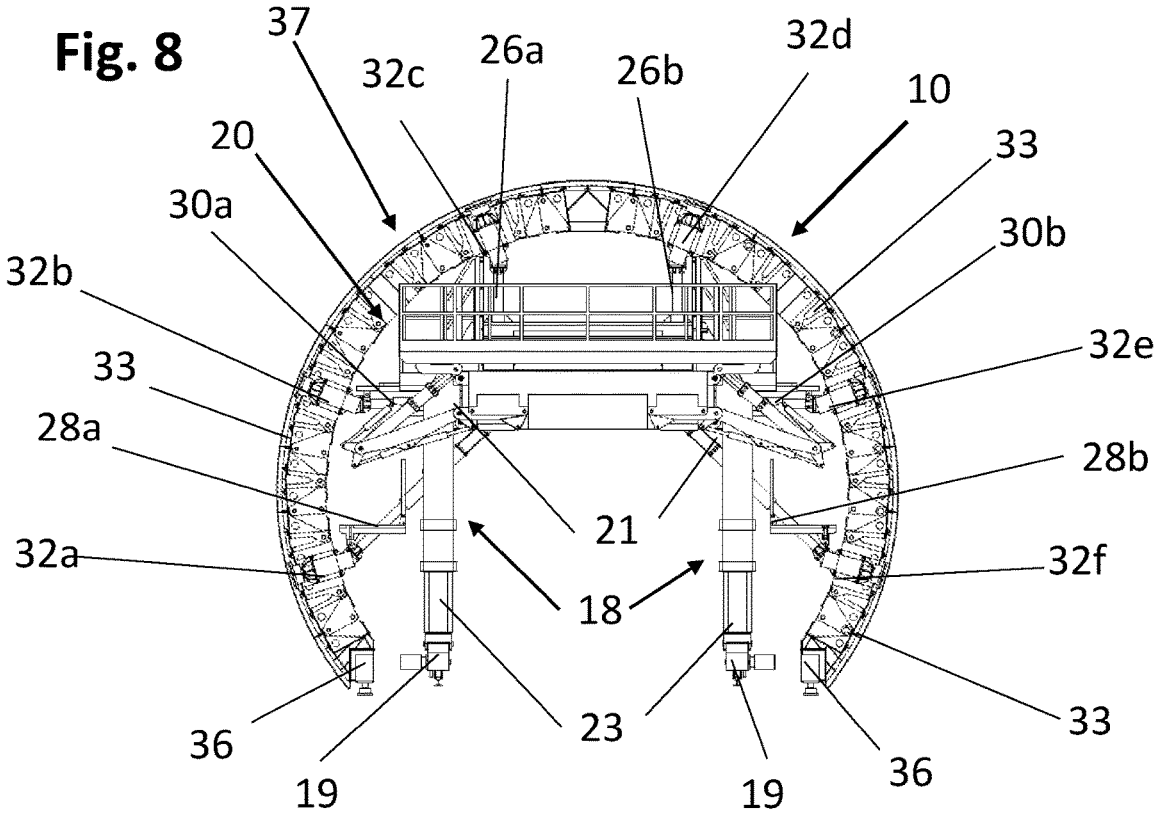
FIG. 8 is a frontal view of the tunnel formwork assembly from a longitudinal end.

FIG. 8 shows the complete tunnel formwork device 10 in cross-section with the frame 20 supported on the supporting legs 18, with the supporting cylinders 26*a*, 26*b*, 28*a*, 28*b* and 30*a*, 30*b* arranged on the frame 20, the longitudinal beams 32*a-f* supported on the supporting cylinders and extending in the longitudinal direction of the tunnel formwork device 10 (=tunnel direction), the tunnel formwork elements 33 stretched between them, which together form the tunnel formwork.

Figure 9:
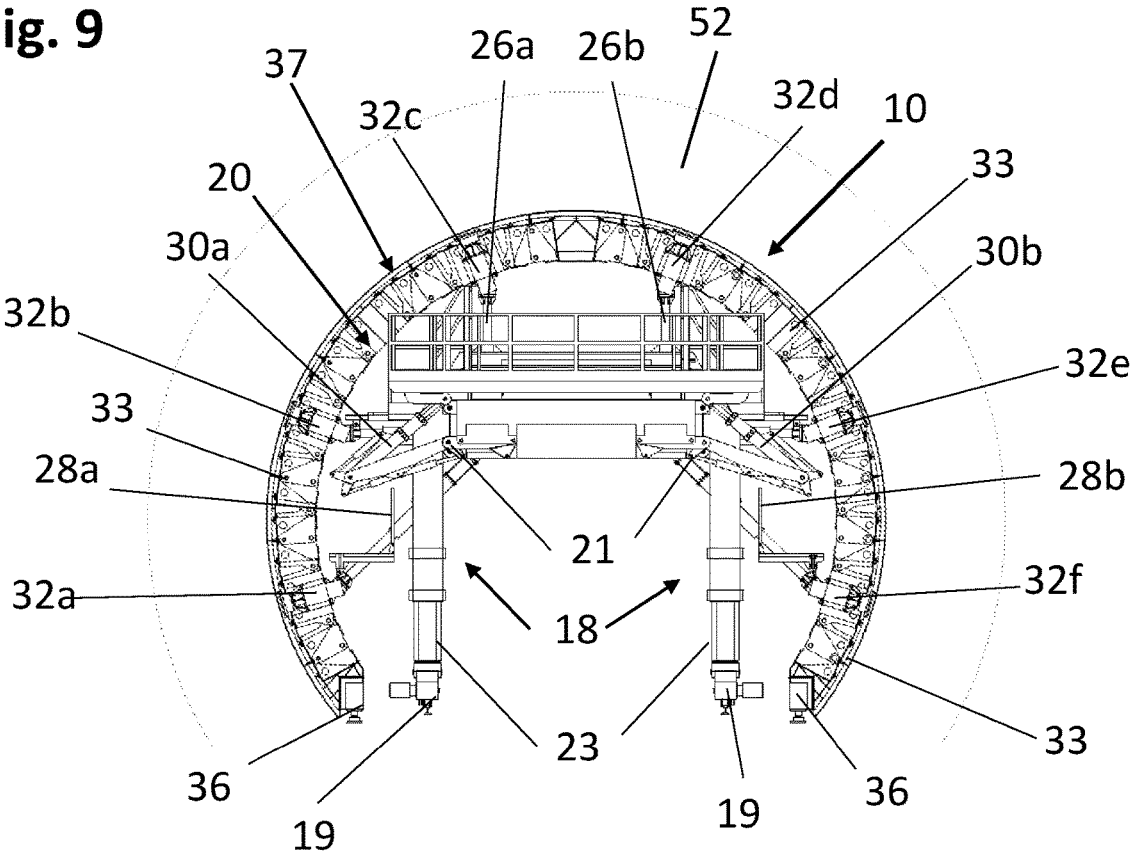
FIG. 9 is a view according to FIG. 8 showing the possible working area of the tunnel formwork device.

FIG. 9 shows the possible working range 52 of the tunnel formwork device, i.e. which tunnel cross-sections can be covered with the tunnel formwork device 10, by adjusting the length of the supporting cylinders 26*a*, 26*b*, 28*a*, 28*b* and 30*a*, 30*b*, by adjusting the vertical telescopic mechanisms 23 for height adjustment of the supporting legs 18, by adjusting the horizontal telescopic mechanism 21 or by installing adapter pieces for the mutual spacing of the supporting legs 18. The vertical longitudinal support cylinders 26*a*, 26*b* can also be non-adjustable in length, in which case the height adjustment is performed solely by the vertical telescopic mechanism 23 for the support legs 18.

Figure 10:
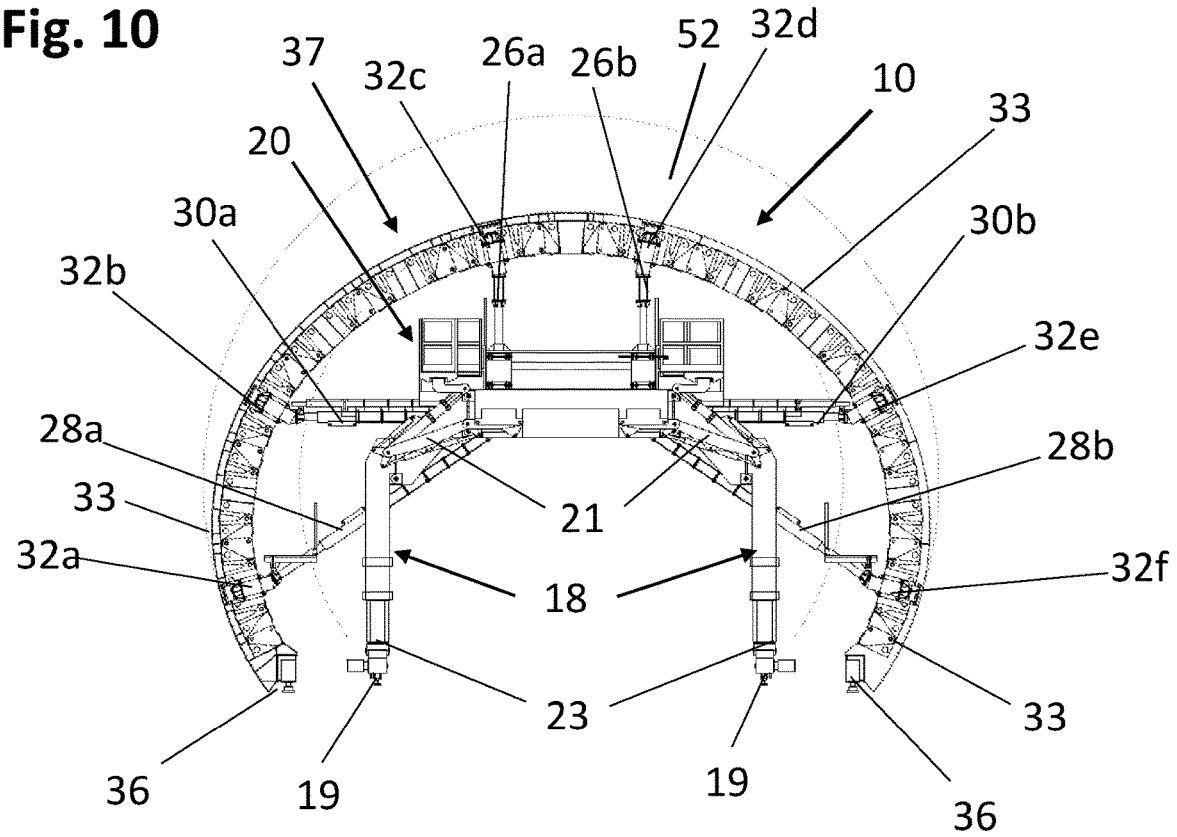
FIG. 10 is a view according to FIG. 8 with a setting for flat and wider tunnels.

This adjustability is shown in FIG. 10 for a flat tunnel tube. Here, the vertical telescopic mechanism 23 for the support legs 18 is not extended much, resulting in a low support height. For this purpose, adapter pieces are inserted into the support legs 18, which provide a greater distance between the two support legs 18 in the transverse direction or width direction of the tunnel formwork device 10. In addition, the inclined downward hydraulic support cylinders 28*a*, 28*b* and the horizontal support cylinders 30*a*, 30*b* are widely extended, resulting in a small height but a large width of the tunnel formwork 37 formed by the tunnel formwork elements 33.

Figure 11:
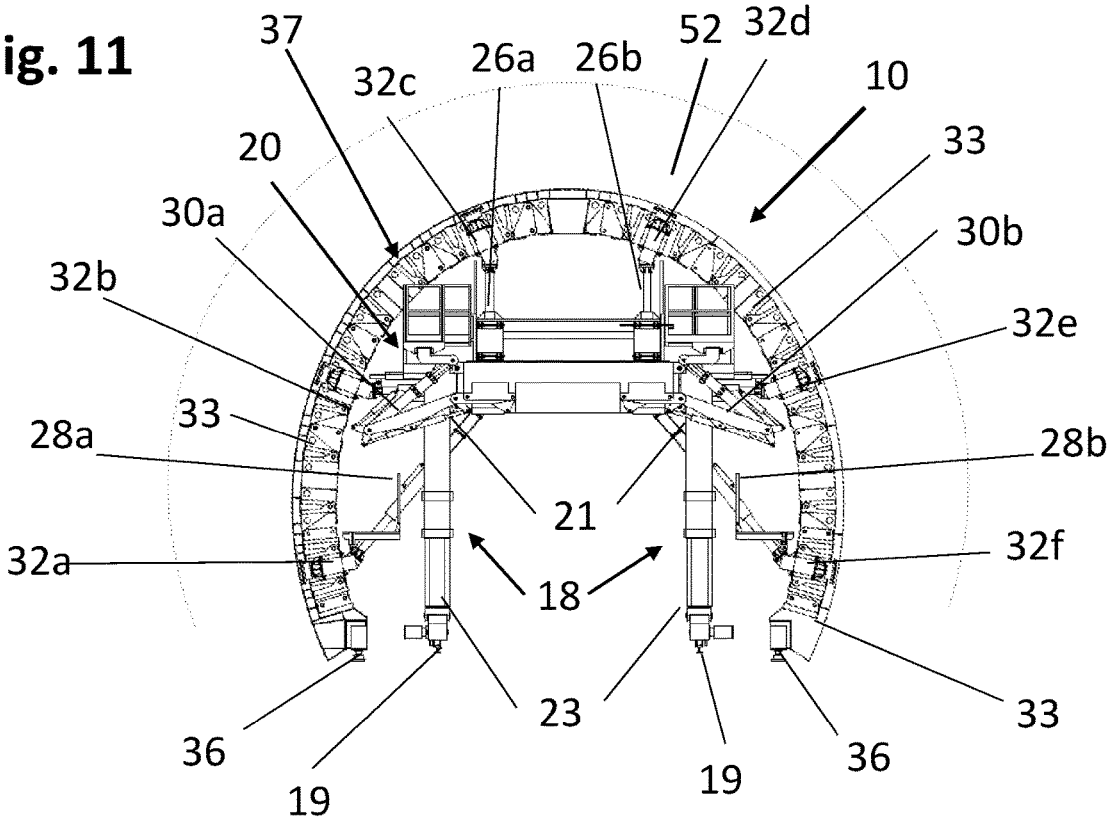
FIG. 11 is a view according to FIG. 8 with a setting for narrower higher tunnels.

FIG. 11 shows the adjustment of the corresponding components for an egg-shaped narrower tunnel wall.

The present invention is not limited to the embodiment example, but may be varied as desired within the scope of the following claims.

LIST OF REFERENCE NUMBERS

10 Tunnel formwork device
12*a,b* End modules
14*a-g* intermediate modules
16*a* Frame part of the end modules
16*b* Frame part of intermediate modules
18 Support structures—support legs
19 Support feet with rollers at the lower end of the support legs
20 Frame of the tunnel formwork device formed by the frame parts of the end and intermediate modules
21 Horizontal hydraulic telescopic mechanism or adapter pieces for width adjustment, i.e. for adjusting the mutual distance of the support legs in the transverse direction
22*a-d* Height-adjustable working platforms, two at each end module
23 Vertical hydraulic telescopic mechanism for height adjustment of the support structure or support legs
24 Hydraulic lifting device for the working platforms, in particular arranged on the frame parts of the end modules
26*a,b* Vertical support cylinders, in particular hydraulically or non-length-adjustable support struts, preferably attached to the frame at a fixed angle
28*a,b* Support cylinders directed obliquely downwards, in particular hydraulically
30*a,b* Horizontal support cylinders, in particular hydraulic
32*a-f* Longitudinal beams running in the longitudinal direction of the tunnel formwork device for supporting the tunnel formwork elements
33 Circular-arc tunnel formwork elements
34 Hydraulically actuated rams on the longitudinal beams for support against the tunnel wall—support rams
35 Tunnel floor
36 Floor support element
37 Tunnel formwork
38 Load sensors
40 Data link
42 Control module
44 Control arrangement
46 Cabin
48 Window
50*a-i* Transport vehicles—semitrailers Trucks with semitrailers
52 Working area of tunnel formwork device in tunnel cross section

The invention claimed is:

1. A modular tunnel formwork device, comprising:

at least two modules, which are arranged one behind the other in a longitudinal direction of the tunnel formwork device and can be detachably connected to one another, wherein the at least two modules each have a frame part, and the frame parts of the at least two modules form a frame of the tunnel formwork device, at least two support structures, which can be connected to the frame of the tunnel formwork device and are spaced apart from one another in the longitudinal direction of the tunnel formwork device, for supporting the frame on a tunnel floor, wherein the frame carries at least two support struts in the form of support cylinders in at least two mutually spaced positions in the longitudinal direction, which support cylinders are selectively connected to longitudinal beams extending in the longitudinal direction, which longitudinal beams carry tunnel formwork elements of the tunnel formwork device.

2. Tunnel formwork device according to claim 1, wherein the modules comprise two end modules, which form the two ends of the tunnel formwork device in the longitudinal direction of the tunnel formwork device, and at least one intermediate module, which is to be arranged between the end modules and can be connected in a form-fitting and/or force-fitting manner to at least one of the two end modules.

3. Tunnel formwork device according to claim 1, wherein each of the at least two supporting structures is height-adjustable and is formed by hydraulically telescopic supporting legs.

4. Tunnel formwork device according to claim 1, wherein the two supporting cylinders are each supported on the frame part by at least two modules.

5. Tunnel formwork device according to claim 4, wherein the frame part of the at least two modules carries at least six supporting cylinders, two of which project vertically upwards, and four of which are directed horizontally or obliquely upwards or downwards.

6. Tunnel formwork device according to claim 1, wherein at least one of the at least two supporting cylinders is pivotably articulated to the frame or frame part and/or in that the longitudinal beams are connected to the supporting cylinders in each case via a pivotable joint.

7. Tunnel formwork device according to claim 1, wherein the modules comprise two end modules and at least one intermediate module, and wherein a length of the intermediate and/or end module in the longitudinal direction is between 1 m and 4 m and a width is between 3 m and 10 m.

8. Tunnel formwork device according to claim 1, wherein the longitudinal beams have hydraulically actuated rams for support on a tunnel wall/tunnel ceiling.

9. Tunnel formwork device according to claim 1, wherein each supporting structure is formed by in each case two height-adjustable and/or width-adjustable supporting legs which can be detachably connected to the frame.

10. Tunnel formwork device according to claim 1, wherein at least one working platform is mounted on the frame, which platform is supported on the frame in a movable manner to be height-adjustable and/or laterally adjustable via a lifting device.

11. Tunnel formwork device according to claim 10, wherein the modules comprise two end modules and at least one intermediate module, and wherein only the frame parts of intermediate modules carry hydraulic supporting cylinders and that the frame parts of end modules carry the respective at least one working platform.

12. Tunnel formwork device according to claim 1, wherein the modules comprise two end modules and at least one intermediate module, and wherein each of the end and/or intermediate module has integrated connections for air and/or hydraulics and/or electrics.

13. Tunnel formwork device according to claim 1, further including load sensors for forces acting on the supporting cylinders, which are connected to a control arrangement for the supporting cylinders.

14. Tunnel formwork device according to claim 1, further including a control module with a control arrangement for the hydraulic support cylinders.

15. Tunnel formwork device according to claim 14, wherein a control arrangement for electrics and hydraulics of the tunnel formwork device is arranged in a cabin or a control cabinet.

16. Tunnel concreting device comprising a tunnel formwork device according to claim 1 and at least one concrete pump which is controlled by a control arrangement for controlling the support cylinders of the tunnel concreting device, at least one delivery line of the concrete pump being connected to an intermediate space between the tunnel formwork elements and a tunnel wall, the concrete pumps being controllable in dependence on signals from load sensors arranged in connection with the support cylinders.

17. A mobile formwork arrangement with a tunnel formwork device according to claim 1 and at least three transport vehicles for receiving the modules and supporting structures, which transport vehicles are formed by an articulated truck or an articulated trailer of a freight train.

* * * * *